US005454635A

United States Patent [19]

Johnson

[11] Patent Number: 5,454,635

[45] **Date of Patent: * Oct. 3, 1995**

[54] CARD ORGANIZER CABINET

[76] Inventor: Leslie D. Johnson, 6014 Loretta St., Lansing, Mich. 48911

[ * ] Notice: The portion of the term of this patent subsequent to Jan. 4, 2011 has been disclaimed.

[21] Appl. No.: 176,201

[22] Filed: Jan. 3, 1994

Related U.S. Application Data

[63] Continuation-in-part of Ser. No. 847,172, Mar. 6, 1992, Pat. No. 5,275,481.

[51] Int. Cl.[6] ..... A47B 63/00

[52] U.S. Cl. ..... 312/183; 312/187; 312/258; 312/348.3

[58] Field of Search ..... 312/183, 187, 312/259, 261, 348.3, 348.5, 258, DIG. 902; 211/11, 126; 206/449, 491

[56] References Cited

U.S. PATENT DOCUMENTS

| | | | |
|---|---|---|---|
| 254,836 | 3/1882 | Nauerth . | |
| 386,673 | 7/1888 | Wells . | |
| 386,675 | 7/1888 | Wells . | |
| 590,666 | 9/1897 | Macrae . | |
| 660,541 | 10/1900 | Field . | |
| 867,599 | 10/1907 | Rand . | |
| 877,600 | 1/1908 | Sawyer . | |
| 970,103 | 9/1910 | Parrott . | |
| 1,030,317 | 6/1912 | Middaugh . | |
| 1,113,182 | 10/1914 | Avery . | |
| 1,467,357 | 9/1923 | Davies . | |
| 1,603,776 | 10/1926 | Joly . | |
| 1,613,570 | 1/1927 | Shotwell . | |
| 2,665,808 | 1/1954 | McAlister | 312/183 |
| 3,554,429 | 1/1971 | Cohen | 206/491 |
| 4,437,713 | 3/1984 | Roach | 312/259 |
| 4,572,547 | 2/1986 | Phillips | 312/183 |
| 4,595,246 | 6/1986 | Bross | 312/348.3 |
| 4,756,581 | 7/1988 | Phillips | 312/183 |

FOREIGN PATENT DOCUMENTS

| | | | |
|---|---|---|---|
| 3720741 | 1/1989 | Germany | 211/11 |
| 1160414 | 8/1969 | United Kingdom | 312/348.3 |

*Primary Examiner*—Victor N. Sakran
*Attorney, Agent, or Firm*—Ian C. McLeod

[57] ABSTRACT

A card organizer device (10) supported in a cabinet (12) for depositing cards (14) moved into the card organizer device into the cabinet, is described. The card organizer device is comprised of a plurality of panels (26) connected together by dividers (28) to form a plurality of compartments (30) for receiving cards that have been first sorted and then moved through the open top of the holders and into the compartments. The device is also provided with an open bottom which provides for depositing the cards into the cabinet when the card organizer device is removed from the cabinet. That way, the cards lay in the cabinet in a fanned and sorted order. The sorted cards can then be removed from the cabinet and placed back into a conventional set box container. The sorted cards can then be held in the set box container for appreciation or resale. A cover is also provided that mounts over the cards and the card organizer device mounted in the cabinet to protect the sorted cards.

14 Claims, 3 Drawing Sheets

CARD ORGANIZER CABINET

REFERENCE TO RELATED APPLICATION

This application is a continuation-in-part of U.S. Application Ser. No. 07/847,172, filed Mar. 6, 1992 now U.S. Pat. No. 5,275,481.

BACKGROUND OF THE INVENTION

1. Field of the Invention

The present invention relates to an organizer device for cards. In particular, the present invention relates to a device for organizing cards, particularly collectible cards, into a container for temporarily holding the cards until they are organized in numerical order. The organized cards are then deposited from the organizer device into the container where they are picked up and placed in a set box container for the cards. A set box container is a package constructed to hold a numbered set of the collectible cards.

The card organizer device is preferably comprised of a holder unit having an open top and an open bottom. The holder unit has a plurality of compartments which are formed by spaced apart panels connected together by dividers. The panels are preferably provided with indicia at each compartment for labeling the compartments. In use, the card organizer device is first mounted in a container or cabinet. The cards are usually sold in a random order. The cards are then sorted and placed in compartments in a holder unit of the organizer device according to alphabetic, numerical or some other pertinent order. The organizer device can then be removed from the container by grasping each end of the organizer device and lifting the organizer device out of the container, leaving the sorted cards in the container. The organized cards deposited in the container are then picked up, in order, and placed back into the set box container for the cards. A removeable cover mounts over the card organizer device mounted in the cabinet to protect the sorted cards while they are held in the organizer device mounted in the container. Also, the card organizer device enables the collectible cards to be sorted and ordered without damaging the cards by scratching their faces or wearing or rounding the card edges. This helps to retain the intrinsic value of the collectible cards.

2. Prior Art

The prior art has described various types of devices for sorting and filing cards, check vouchers, important papers and the like. Some of these devices are provided with moveable partitions for varying the space between adjacent partitions. This enables a user of the device to adjust the size of the compartment formed between adjacent partitions depending on the amount of papers and the like that are filed in a particular compartment. Illustrative of these prior art devices are U.S. Pat. Nos. 254,836 to Nauerth; 386,673 to Wells; 386,675 to Wells; 590,666 to Macrae; 660,541 to Field; 867,599 to Rand; 877,600 to Sawyer; 970,103 to Parrott; 1,030,317 to Middaugh; 1,603,776 to Joly and 1,613,570 to Shotwell.

Nauerth describes a file for postal and other cards. The file is comprised of a case having an open side. Partitions are adjustably mounted on rods provided adjacent to an upper wall of the case while recesses are provided on an opposite lower wall. The recesses mate with pins depending from the partitions to limit the lateral movement of the partitions to vary the size of the included compartment.

Wells describes two types of paper or bill files. U.S. Pat. No. 386,673 describes a bill file comprised of a base having a pair of grooves extending lengthwise along opposed side portions of the base. A plurality of partitions are mounted on the base. The partitions have opposed inwardly bent rims at a lower end of the partition that mate with the grooves to provide for adjusting the partitions along the base. U.S. Pat. No. 386,675 describes a bill file comprised of a base having a pair of slide rods mounted lengthwise along opposed side portions of the base. A plurality of partitions are provided with legs having openings that provide for the partitions to slide along the rods for adjusting the partitions. These bill files do not provide for depositing the bills in a container after the bills have been sorted.

Macrae describes a check sorter or separator comprised of an open box-like case having a pair of guide rods extending longitudinally along the inside sidewalls of the case and adjacent to the open top of the case. A plurality of partitions are slideably mounted on the guide rods to form compartments for the checks. A plunger or follower is mounted on the rods at one end of the plurality of partitions. The plunger serves to hold the partitions and sorted checks together in a compressed relationship.

Field describes a portable and collapsible case having a plurality of partitions connected together in the shape of pleated bellows. The partitions have tapered corners for seeing the card held by the partition. When the case is collapsed, a strap can be drawn around the case to hold it in the collapsed position.

Rand describes a sorting device having a base provided with a central groove that extends the majority of the length of the base. A slide rod is mounted along the length of the groove. The slide rod provides for slideably supporting partitions mounted on slide blocks to adjust the distance between the partitions.

Sawyer describes a file case having a false bottom mounted on a base wall of the file case. The false bottom provides for mounting a slide rod. A follower plate is slideably mounted on the slide rod for compressing partitions and cards sorted between the partitions together in the file case. A tip lid is hinged to one of the sidewalls and the opposite sidewall is hinged to the base for opening the case.

Parrott describes a card holder rack that is provided with month and day indicia for filing cards of scheduled events. The partitions in the holder are provided with a cut out portion that permits convenient access to the filed cards. There is no means of removing the filed cards from the back of the holder.

Middaugh describes a file holder having an open front and top sides. A guide rod is mounted between the end walls and adjacent to the bottom. Partitions are slideably mounted on the guide rods to adjust the distance between the partitions for filing papers in the holder. The back of the holder can be opened for removing papers from the holder; however, the file holder is not adapted for sorting cards into a container for the cards.

Shotwell describes an index file having an open top and with a guide rod extending the length of the file, adjacent to the bottom wall. Individual folder units are slideably mounted on the guide rod. The folders have a pocket that provides for mounting papers and the like. An outer flap portion of each folder provides for identifying the contents of the folder.

Joly describes a card sorting device and system for filing. The sorting device is divided into several series of compartments separated by partitions. The series of compartments are useful for successive sorting of cards according to alphabetic order, numerical sequence or some other established criteria. This device does not provide for depositing the sorted cards in a separate container for the cards.

Other patents more remotely related to the present invention include U.S. Pat. Nos. 1,113,182 to Avery and 1,467,357 to Davies.

What is not shown by the prior art and what is needed is an organizer device that is mountable in a container, which serves as both a support for the organizer device and as a container for the sorted cards. To serve that purpose, the organizer device needs to have an open top and an open bottom with a plurality of partitions mounted on longitudinal support walls between the open top and bottom. The sorted cards are received in compartments formed by the partitions. After the cards have been sorted, the organizer device can be removed from the container, thus depositing the sorted cards in the container.

OBJECTS

It is therefore an object of the present invention to provide a device for organizing cards and the like wherein after the cards have been sorted into the organizer device, the organizer device can be removed from a container supporting the organizer device for depositing the sorted cards into the container. Further, it is an object of the present invention to provide a method for organizing cards, such as collectible cards and the like into a container for the cards. Finally, it is an object of the present invention to provide a card organizer device that is inexpensive to build, easy to construct and durable in construction for sorting and organizing cards and the like. These and other objects will become increasingly apparent by reference to the following descriptions and to the drawings.

DETAILED DESCRIPTION OF THE PREFERRED EMBODIMENTS

Figure 1:
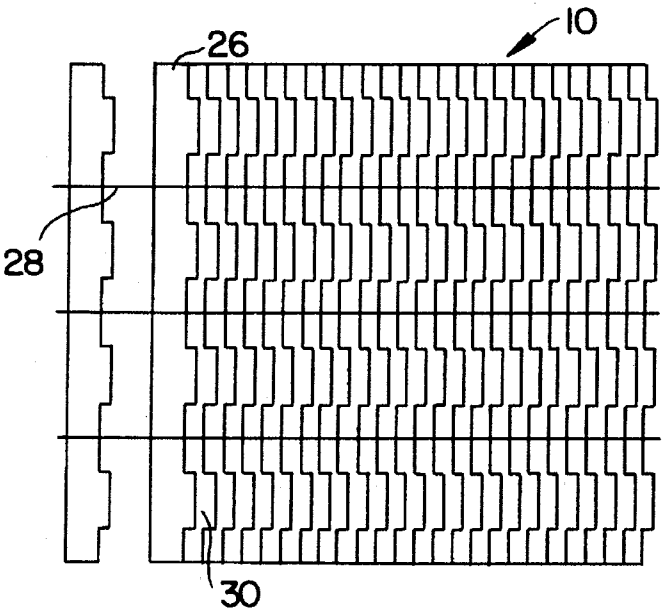
FIG. 1 is a top view of the card organizer device 10 of the present invention showing the panels 26 and the dividers 28.
Figure 2:
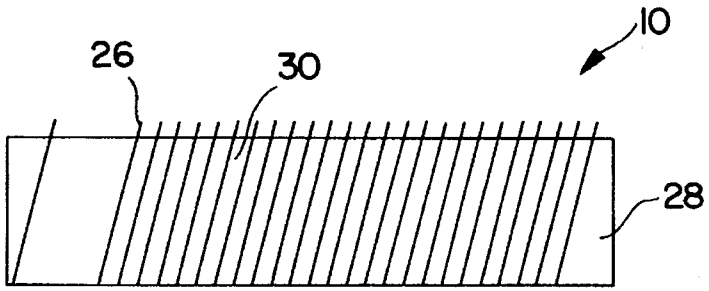
FIG. 2 is a side view of the card organizer device 10 of FIG. 1 showing the panels 26 and one divider 28.

The present invention relates to a device for organizing cards into a container means having a bottom wall and a sidewall extending from the bottom wall, which comprises: a holder means for holding and organizing the cards that is adapted to be removeably mounted in the container means, wherein the holder means is comprised of an open top and an open bottom with a plurality of partition means which divide the holder means into a plurality of compartments adapted to receive cards moved into compartments of the holder means so that after the cards are moved into the compartments of the holder means, the holder means is removed from the container means and wherein the cards, moved into the compartments of the holder means, remain in the container means after the holder means is removed from the container means.

Further, the present invention relates to a device for organizing cards into a container means having a bottom wall with spaced apart sidewalls extending from the bottom wall and opposed end walls between the sidewalls, which comprises: a holder means that is adapted to be removeably mounted in the container means for holding and organizing the cards, wherein the holder means has an open top and an open bottom with a plurality of partition means which divide the holder means into a plurality of compartments adapted to receive cards moved into the holder means so that after the cards are moved into the compartments of the holder means, the holder means is removed from the container means and wherein the cards moved into the compartments of the holder means remain in the container means after the holder means is removed from the container means.

Still further, the present invention relates to a method for organizing cards into a container means having a bottom wall with spaced apart sidewalls extending from the bottom wall and opposed end walls between the sidewalls, which comprises: providing a card organizing device, which comprises: a holder means for the cards having an open top and an open bottom and mountable in the container means, with a plurality of partition means in the holder means to divide the holder means into a plurality of compartments for receiving cards moved into the compartments of the holder means; mounting the card organizing device inside the container means so that the container means helps to support the card organizing device; moving the cards into the compartments of the holder means to thereby organize the cards; removing the organizing device from the container means to deposit the cards moved into the compartments of the holder means in the container means through the open bottom of the holder means; and removing the cards from the container means and placing the organized cards in a package means.

Finally, the present invention relates to a device for organizing cards having a face between opposed sides into a container means having a bottom wall and a sidewall extending from the bottom wall, which comprises: a holder means for holding and organizing the cards that is adapted to be removeably mounted in the container means, wherein the holder means is comprised of an open top and an open bottom with a plurality of compartments which are formed of spaced apart panels which extend across the face of the cards wherein the panels are held together by divider means which extend along the sides of the cards, wherein the panels and the divider means are held together by interconnecting slots, wherein the plurality of compartments are adapted to receive cards moved into the holder means so that after the cards are moved into the compartments of the holder means, the holder means is removed from the container means and wherein the cards moved into the compartments of the holder means remain in the container after the holder means is removed from the container means.

FIGS. 1 to 5 show the preferred embodiment of a card organizer device 10 of the present invention. The card organizer device 10 is removeably mounted inside of a container or cabinet 12 for depositing cards 14 moved into the card organizer device 10 into the cabinet 12. The cabinet 12 is comprised of a bottom wall 12A having opposed outside sidewalls 12B and extending from the bottom wall 12C and with spaced apart rear and front end walls 12D and 12E and extending between the outside sidewalls 12B. The outside sidewalls 12B and the rear and front end walls 12D and 12E preferably extend upwards from the bottom wall 12C a distance of about 4 inches (10.2 cm).

Figure 3:
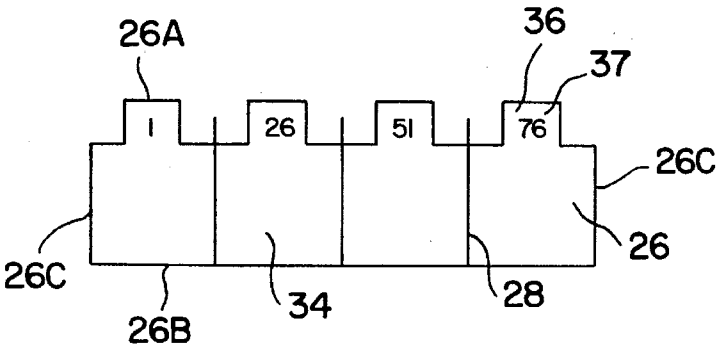
FIG. 3 is a front view of the card organizer device 10 of FIG. 1 showing the indicia 37 on the tabs 36 of the panels 26 and the dividers 28.
Figure 4:
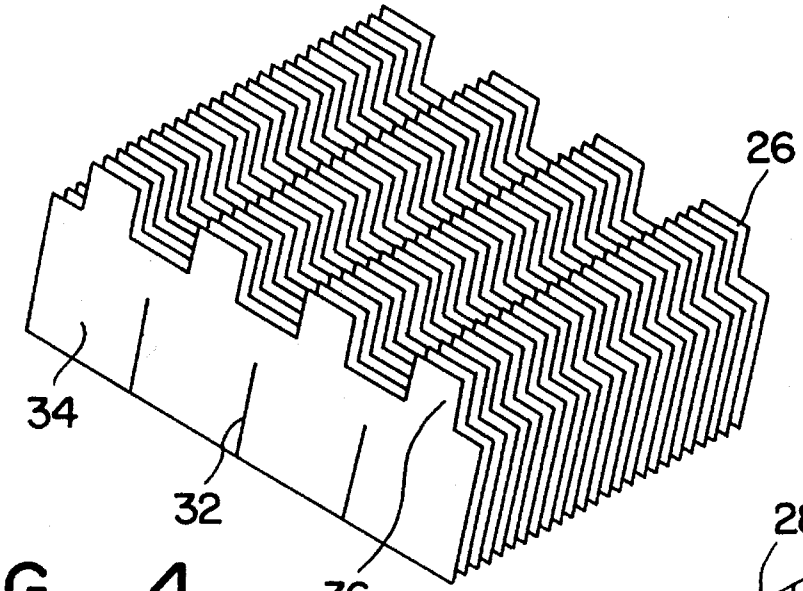
FIG. 4 is a perspective view of the panels 26 showing the tabs 36 and the vertical slots 32.

As particularly shown in FIG. 1, the card organizer device 10 includes panels 26 connected together by dividers 28 to form a plurality of compartments 30. The panels 26 have a top 26A and a bottom 26B with sides 26C therebetween. Preferably, all the panels 26 are identical and therefore only one will be described in detail. The panels 26 is provided with vertical slots 32 which extend upward from the bottom 26B of the panel 26 parallel to the sides 26C of the panel 26 (FIG. 4). Preferably, the vertical slots 32 extend upward approximately three fourths of the height of the panel 26. In the preferred embodiment, there are three vertical slots 32 in each panel 26 which divide the panel 26 into four even sections 34. The top 26A of the panel 26 is preferably provided with tabs 36 extending along the top 26A between the sides 26C of the panel 26. Preferably, each panel 26 has four tabs 36 along the top 26A which are centered over the four sections 34 of the panel 26. The tabs 36 are preferably provided with indicia 37 to label the compartments 30 in order to identify the card 14 moved into the compartments 30 of the card organizer device 10 (FIG. 3). In the preferred embodiment, the card organizer device 10 has 26 panels 26 having a length of 11 cm and a height of 2.75 cm. The vertical slots 32 extend upward 1.88 cm and are spaced 2.75 cm such that the panels 26 are split into four sections 34 2.75 cm apart in width.

Figure 5:
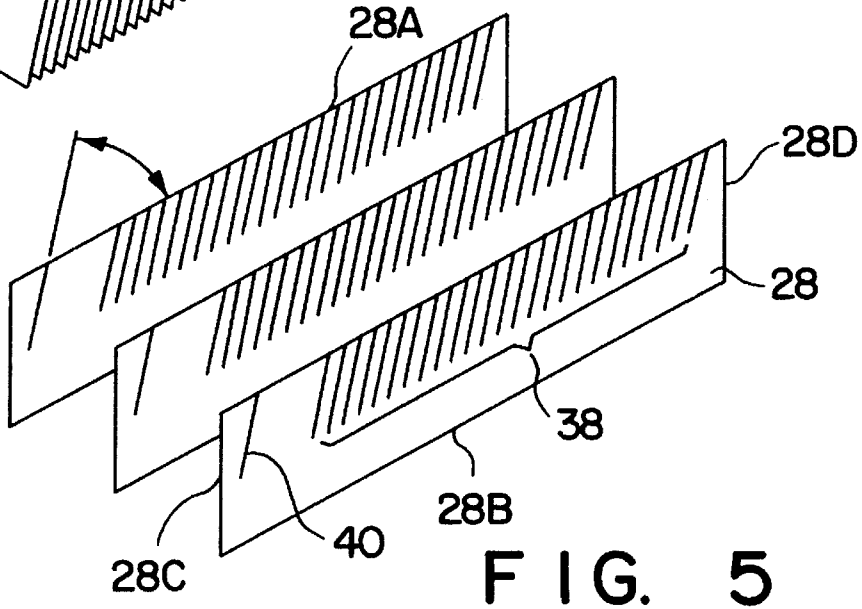
FIG. 5 is a perspective view of the dividers 28 showing the first angled slot 40 and the second angled slots 38.

As shown in FIG. 5, the dividers 28 have a top 28A and a bottom 28B with a front side 28C and a back side 28D, therebetween. Preferably, each divider 28 is similar and therefore only one need be described in detail. The divider 28 is provided with one first angled slot 40 and a plurality of second angled slots 38 all of which extend downward from the top 28A of the divider 28. The first and second angled slots 40 and 38 preferably extend downward from the top 28A slightly more than half the distance from the top 28A to the bottom 28B of the dividers 28. Preferably, the first angled slot 40 is spaced 1 inch from the front side 28C of the divider 28. The first angled slot 40 is spaced apart from the second angled slots 38 toward the front side 28C of the divider 28. In the preferred embodiment, the first angled slot 40 is spaced apart from the adjacent second angled slot 38 1.84 cm. The second angled slots 38 are all spaced 0.41 cm apart from each other.

The first and second angled slots 38 and 40 are preferably angled between 45 and 75 degrees from the plane formed by the top 28A of the dividers 28 with 75 degrees being the optimum angle. In the preferred embodiment, there are 26 slots spaced along the length of the dividers 28 including the spaced apart first angled slot 40. Preferably, the dividers 28 have a height of 3.25 cm and a length of 13 cm.

To form the card organizer device 10, the vertical slots 32 of panels 26 are inserted into the first and second angled slots 38 and 40 of the dividers 28 such that the panels 26 are interlocked with the dividers 28. The panels 26 are mounted within the dividers 28 such that the indicia 37 on the tabs 36 of the panels 26 are all facing the same way. Preferably, the indicia 37 on the tab 36 of the panel 26 labels the compartment 30 directly behind the panel 26 containing the indicia 37. The number of vertical slots 32 in the panels 26 is equal to the number of dividers 28 and similarly the total number of first and second angled slots 38 and 40 in the dividers 28 is equal to the number of panels 26 in the device 10. Preferably, the (27) twenty-seven panels 26 and (3) three dividers 28 form 100 standard sized compartments 30 and (4) four oversized compartments 31 which are spaced between the first angled slot 40 and the adjacent second angled slot 38. Preferably, the standard sized compartments 30 have a width between the panels 26 of about 0.41 cm which is approximately equal to the distance between the second angled slots 38 of the dividers 28. This width provides room for moving the cards 14 into the compartments 30. It is understood that the width of the compartments 30 can be varied in order to accommodate a different thickness of cards 14 or to accommodate duplicates. The oversized compartments 31 have a width between the panels 26 of about 1.84 cm. The oversized compartments 31 are preferably located adjacent the front end wall 12E of the cabinet 12 and allow for storage of several cards 14 prior to sorting. Preferably, the oversized compartments 31 are able to hold 100 standard cards 14. In addition, the angling of the first and second angled slots 38 and 40 of the dividers 28 ensure that the compartments 30 are angled with respect to the top side 28A of the dividers 28. The angling of the compartments 30 enables the user to easily slide the cards 14 into the device 10. The angled panels 26 also helps prevent damage to the cards 14 during sorting into the device 10. The angling of the panels 26, allows the user to slide the cards 14 into the compartments 30 along the panels 26 rather than having to drop the cards 14 into the compartments 30 and risk damaging the cards 14 due to contact with the bottom wall 12A of the cabinet 12.

Figure 1B:
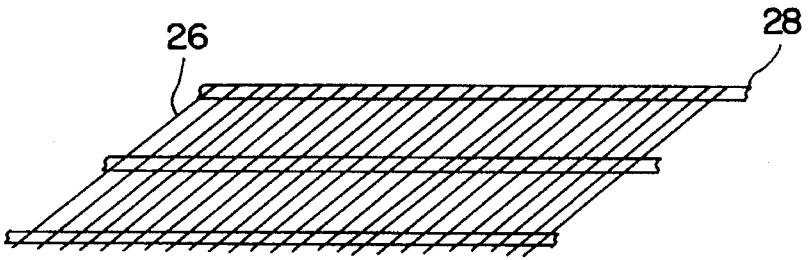
FIG. 1B is a plan view of the card organizer device 10 of FIG. 1 in the collapsed position showing the panels 26 and the dividers 28.
Figure 1A:
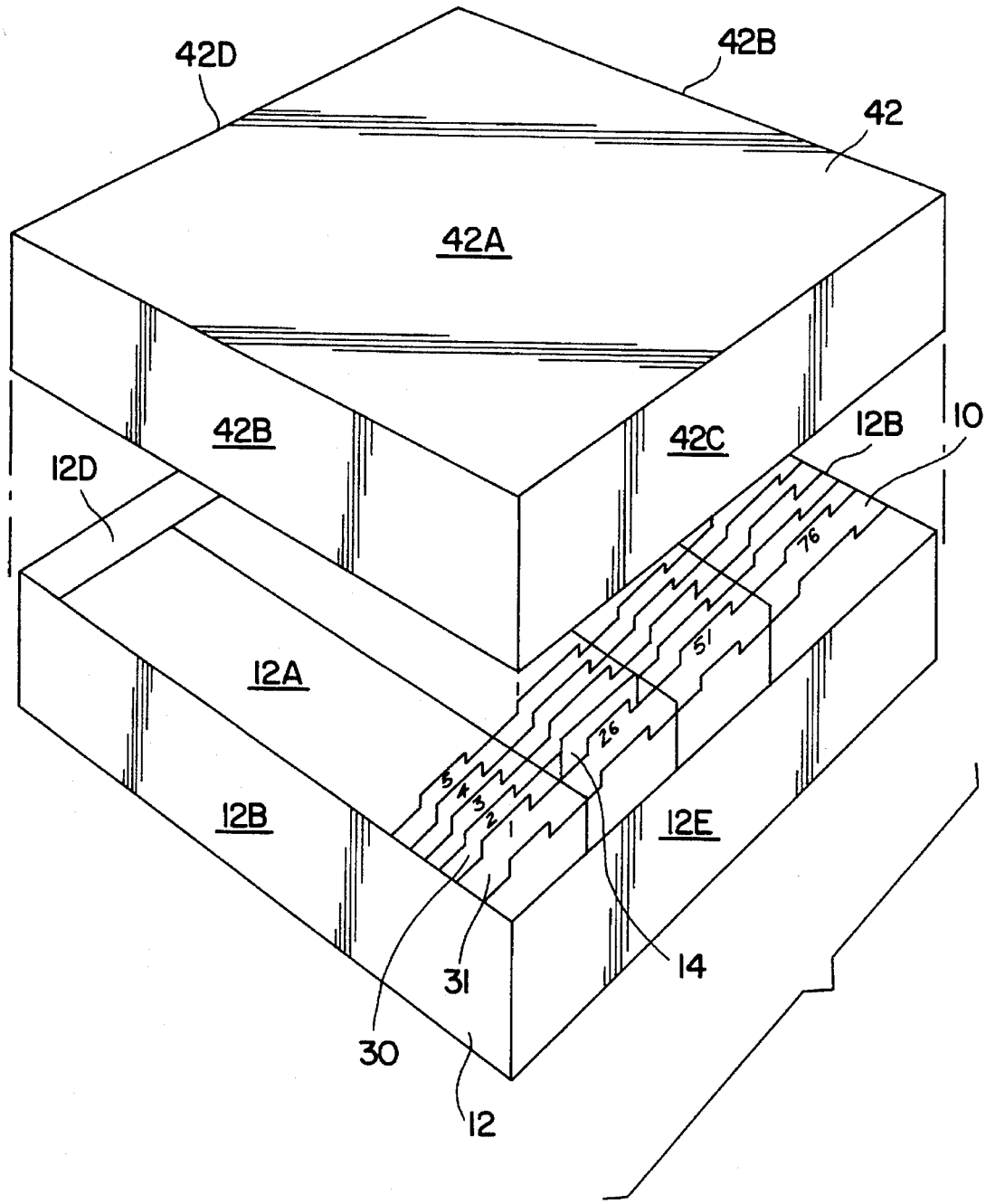
FIG. 1A is a perspective view of the card organizer device 10 having only 6 panels 26 for clarity in the cabinet 12 with the lid 42.

As shown in FIG. 1A, the card organizer device 10 is completed by a removeable lid 42 or cover comprised of a top wall 42A, opposed side walls 42B with front and rear end walls 42C and 42D between the side walls 42B and depending from the top wall 42A. The cover 42 is sized to mount over the card organizer device 10 mounted in the cabinet 12 to protect the cards 14 held in the card organizer device 10.

IN USE

The card organizer device 10 is mounted within the cabinet 12 such that the panels 26 extend between and perpendicular to the outside sidewalls 12B of the cabinet 12 while the three dividers 28 extend between the front and rear end walls 12E and 12D of the cabinet 12 with the front side 28C of the dividers 28 adjacent the front end wall 12E of the cabinet 12 (FIG. 1A). Preferably, the card organizer device 10 is mounted within the cabinet 12 such that the indicia 37 on the tabs 36 of the panels 26 face the front end wall 12E of the cabinet 12. The outside sidewalls 12B of the cabinet 12 act to support the card organizer device 10 and provide for centering the sorted cards 14 in their respective compartments 30.

The cards 14 are sorted according to alphabetic, numerical or some other pertinent criteria. The sorted cards 14 are then inserted into the compartments 30. The cards 14 are inserted into the compartments 30 such that the panels 26 of the device 10 extend across the face (not shown) of the cards 14 and the dividers 28 extend along the sides (not shown) of the cards 14. Once all of the cards 14 have been sorted into the device 10, the device 10 is removed from the cabinet 12 leaving the cards 14 in the cabinet 12. Thus, the deposited cards 14 lay in the cabinet 12 in a fanned and sorted order. The sorted cards 14 are then removed from the cabinet 12 and placed back in a conventional set box container (not shown). The sorted cards 14 can then be held in the set box for appreciation or resale.

The panels 26 and dividers 28 are preferably constructed from a stiff, moderately thick paper, such as paperboard. It is understood, however, that the device 10 is able to be constructed from a flexible plastic with a smooth surface so as to not damage the cards 14. The interlocking of the panels 26 and the divider 28 enable the card organizer device 10 to be collapsible. In the collapsed position, the device 10 is essentially flat and has a length longer than the length of the dividers 28. The device 10 collapses along the diagonal of the device 10 such that the dividers 28 remain diagonal with the sections 34 of the panels 26 stacked in four layers (FIG. 1B). The collapsibility of the card organizer device 10 allows for easier shipping and storing of the device 10. Furthermore, the panels 26 and dividers 28 can be permanently interlocked such as by an adhesive (not shown), while still allowing the device 10 to be collapsible. Preferably, however, the device 10 is able to be dismantled in order to allow for easier storage and also to allow for varying the number and size of the compartments 30 in the device 10. It is understood that the greater the number of panels 26 and dividers 28 the more cards 14 that are able to be sorted into the card organizer device 10.

The cards 14 which are moved into the organizer device 10 are preferably collectible cards 14, such as sport and non-sport trading cards, having a height of about 3.5 inches (8.9 cm) and extend above the panels 26 a distance of about 1.0 inches (2.54 cm). This provides for removing the cards 14 from the card organizer device 10. Also, if the cards 14 have a height similar to that of the panels 26, the panels 26 can be provided with finger recesses (not shown) for removing the cards 14 from the card organizer device 10.

The term "card" can encompass any sheet material that needs to be sorted or organized according to an alphabetic, numerical or some other pertinent criteria. Thus, the term card can include, but is not limited to, paper sheet material such as collectible cards, checks, receipts, coupons, postcards, invoices, bills, pay stubs and the like. The term card can also encompass rigid materials such as tiles, and the like, or semi-rigid materials such as carpet samples and the like. Furthermore, the term card is not to be limited by the thickness of the sheet material and in fact a plurality of sheet material bound or otherwise connected together can be considered a card for purposes of the present invention.

It is intended that the foregoing descriptions be only illustrative of the present invention and that the present invention be limited only by the hereinafter appended claims.

I claim:

1. A device organizing cards into a container means having a bottom wall and a sidewall extending from the bottom wall, which comprises:

a holder means for holding and organizing the cards that is to be removeably mounted in the container means and to be collapsible, as a unitary piece wherein the holder means is comprised of an open top and an open bottom with a plurality of partition means which divide the holder means into a plurality of compartments adapted to receive cards moved into compartments of the holder means so that after the cards are moved into the compartments of the holder means, the holder means is removed from the container means and wherein the cards, moved into the compartments of the holder means, remain in the container means after the holder means is removed from the container means.

2. The card organizing device of claim 1 wherein the partition means are at an angle of between 75 and 45 degrees from a vertical plane extending between the spaced apart sidewalls of the container means.

3. The card organizing device of claim 1 adapted to sort collectible cards.

4. The card organizing device of claim 1 adapted to support a cover means when the card organizing device is mounted in the container means to protect the cards moved into the compartments of the holder means.

5. The card organizing device of claim 1 wherein the partition means have indicia for labeling the cards moved into the compartments of the holder means.

6. A device for organizing cards into a container means having a bottom wall with spaced apart sidewalls extending from the bottom wall and opposed end walls between the sidewalls, which comprises:

a holder means that is adapted to be removeably mounted in the container means and to be collapsible as a unitary piece for holding and organizing the cards, wherein the holder means has an open top and an open bottom with a plurality of partition means which divide the holder means into a plurality of compartments adapted to receive cards moved into the holder means so that after the cards are moved into the compartments of the holder means, the holder means is removed from the container means and wherein the cards moved into the compartments of the holder means remain in the container means after the holder means is removed from the container means.

7. The card organizing device of claim 6 wherein the partition means are at an angle of between 75 and 45 degrees from a vertical plane extending between the spaced apart sidewalls of the container means.

8. The card organizing device of claim 6 adapted to sort collectible cards.

9. The card organizing device of claim 6 adapted to support a cover means when the card organizing device is mounted in the container means to protect the cards moved into the compartments of the holder means.

10. A method organizing cards into a container means having a bottom wall with spaced apart sidewalls extending from the bottom wall and opposed end walls between the sidewalls, which comprises:

(a) providing a card organizing device, which comprises: a holder means for the cards having an open top and an open bottom and mountable in the container means, with a plurality of partition means in the holder means to divide the holder means into a plurality of compartments for receiving cards moved into the compartments of the holder means wherein the holder means is to be collapsible as a unitary piece;

(b) mounting the card organizing device inside the container means so that the container means helps to support the card organizing device;

(c) moving the cards into the compartments of the holder means to thereby organize the cards;

(d) removing the organizing device from the container means to deposit the cards moved into the compartments of the holder means in the container means through the open bottom of the holder means;

(e) collapsing the organizing device for storage of the organizing device; and (f) removing the cards from the container means and placing the organized cards in a package means.

11. A device organizing cards having a face between opposed sides into a container means having a bottom wall and a sidewall extending from the bottom wall, which comprises:

a holder means for holding and organizing the cards that is to be removeably mounted in the container means and to be collapsible as a unitary piece, wherein the holder means is comprised of an open top and an open bottom with a plurality of compartments which are formed of spaced apart panels which extend across the face of the cards wherein the panels are held together by divider means which extend along the sides of the cards, wherein the panels and the divider means are held together by interconnecting slots, wherein the plurality of compartments are adapted to receive cards moved into the holder means so that after the cards are moved into the compartments of the holder means, the holder means is removed from the container means and wherein the cards moved into the compartments of the holder means remain in the container after the holder means is removed from the container means for storage of said holder means.

12. The card organizing device of claim 11 wherein the holder means has 27 panels and 3 dividers such that the holder means is divided into 104 compartments.

13. The card organizing device of claim 11 wherein the panels have indicia for labeling the cards moved into the compartments.

14. The card organizing device of claim 11 wherein the panels are at an angle of between 45 and 75 degrees from a plane formed by the bottom wall of the container means when the holder means is mounted in the container means.

* * * * *